US005546067A

United States Patent [19]

Schmidt et al.

[11] Patent Number: 5,546,067

[45] Date of Patent: Aug. 13, 1996

[54] ROTARY POTENTIOMETER ASSEMBLY FOR A PUSH-PULL SWITCH

[75] Inventors: Robert M. Schmidt, Livonia; Mark Feldman, Farmington Hills, both of Mich.

[73] Assignee: United Technologies Automotive, Inc., Dearborn, Mich.

[21] Appl. No.: 355,994

[22] Filed: Dec. 14, 1994

[51] Int. Cl.[6] ..... H01C 10/36; H01C 10/26

[52] U.S. Cl. ..... 338/172; 338/191; 338/152; 338/198; 200/11 DA; 200/11 G; 200/4

[58] Field of Search ..... 338/150, 152, 338/172–173, 191, 198; 200/11 D–11 DA, 11 G, 4

[56] References Cited

U.S. PATENT DOCUMENTS

| | | | |
|---|---|---|---|
| 2,942,220 | 6/1960 | Elliott et al. . | |
| 2,991,337 | 7/1961 | Reihman et al. | 200/4 |
| 3,030,460 | 4/1962 | Huetten et al. | 200/11 G |
| 3,602,868 | 8/1971 | Lybrook . | |
| 3,697,921 | 10/1972 | Urwin | 338/172 |
| 3,838,071 | 9/1974 | Amin . | |
| 3,840,838 | 10/1974 | Tanaka et al. . | |
| 3,924,220 | 12/1975 | Matsui et al. | 338/172 |
| 3,984,744 | 10/1976 | Moody | 338/150 |
| 4,038,504 | 7/1977 | McAnulty et al. | 200/11 DA |
| 4,081,782 | 3/1978 | Hildreth et al. . | |
| 4,117,444 | 9/1978 | Hildreth et al. . | |
| 4,164,633 | 8/1979 | Sheridan et al. . | |
| 4,518,832 | 5/1985 | Geremia . | |
| 4,625,084 | 11/1986 | Fowler et al. | 200/11 G |
| 4,682,142 | 7/1987 | Lohner et al. . | |
| 4,692,805 | 9/1987 | Lopez et al. . | |
| 4,698,552 | 10/1987 | Minami et al. . | |
| 4,827,241 | 5/1989 | Riser et al. . | |
| 4,885,434 | 12/1989 | Vultaggio et al. | 200/4 |
| 5,010,214 | 4/1991 | Yamazaki | 200/11 G |
| 5,140,111 | 8/1992 | Vultaggio et al. | 200/4 |
| 5,180,050 | 1/1993 | Rada et al. | 200/4 |
| 5,264,821 | 11/1993 | Vultaggio et al. | 338/172 |

*Primary Examiner*—Teresa J. Walberg
*Assistant Examiner*—Raphael Valencia
*Attorney, Agent, or Firm*—Howard & Howard

[57] ABSTRACT

A rotary dimmer switch assembly for use with a vehicle push-pull switch controls at least one light dimming function. The rotary switch assembly comprises a stationary cam contact assembly, and a rotating carder assembly which carries a circuit element having an exposed circuit trace surface. The cam contact assembly is fixed to a circuit board and has a plurality of contact arms having one end biased against the circuit element circuit trace surfaces and the other end electrically connected to the circuit board. The cam contact assembly guides the rotation of the carrier assembly about the longitudinal axis of the push-pull switch. The circuit element rotates with the carrier assembly, which is rotated by rotation of a push-pull switching component, and the circuit trace surfaces sweep across the contact arms thereby controlling the light dimming function. A method of assembling the rotary potentiometer assembly is also disclosed.

19 Claims, 3 Drawing Sheets

Fig-1
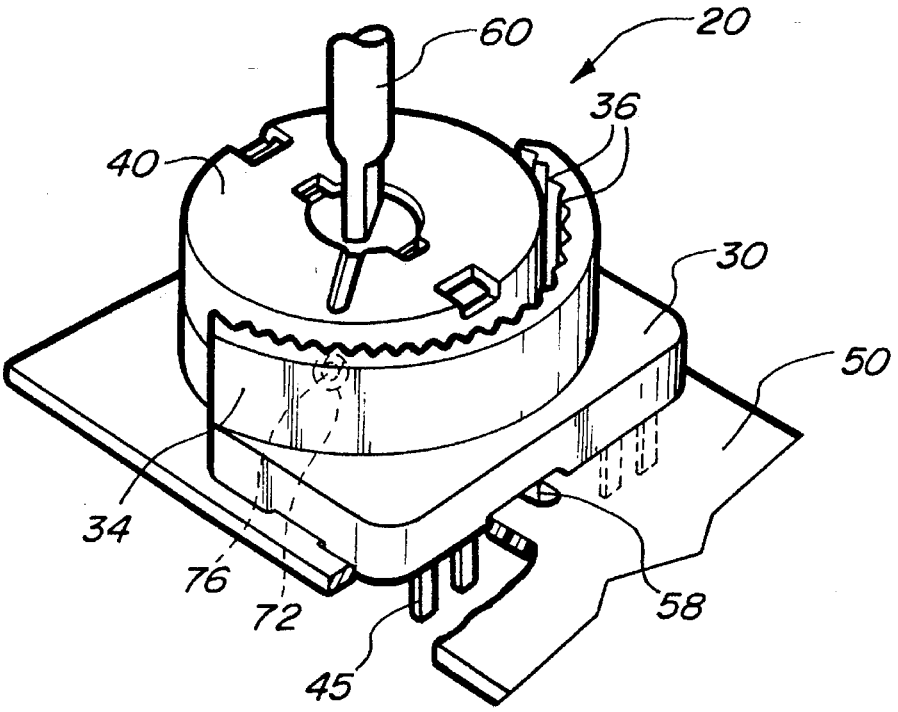
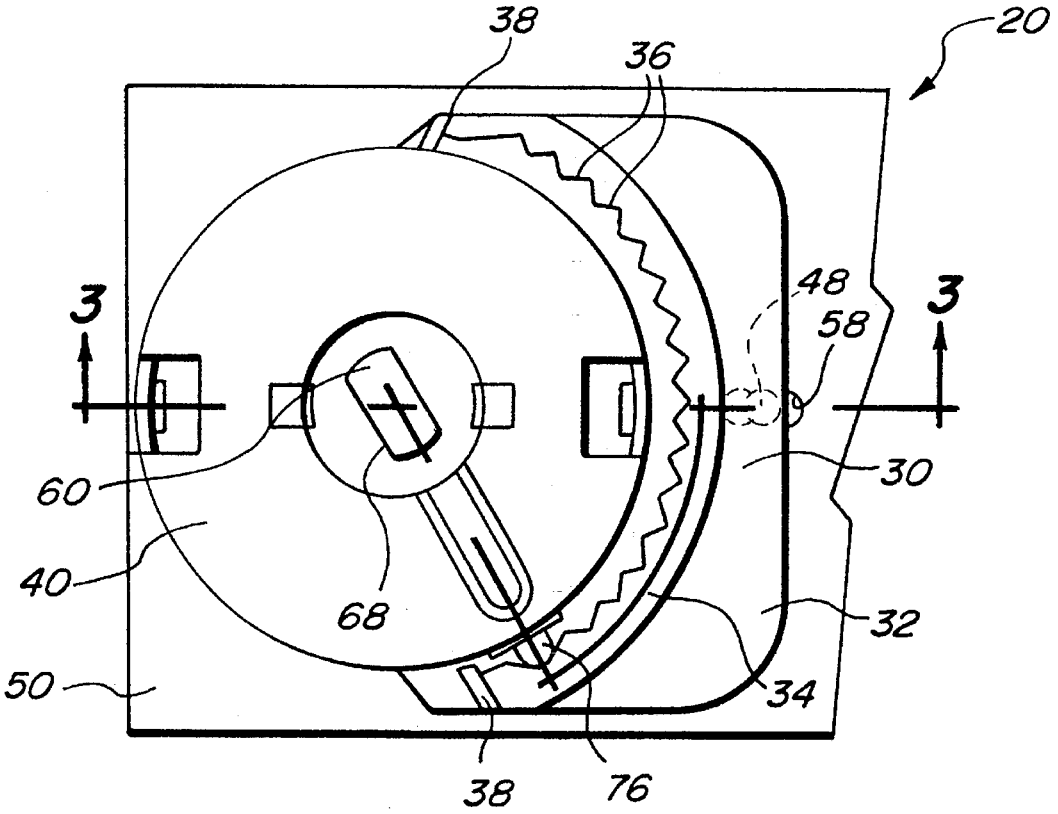
Fig-2

Fig-3
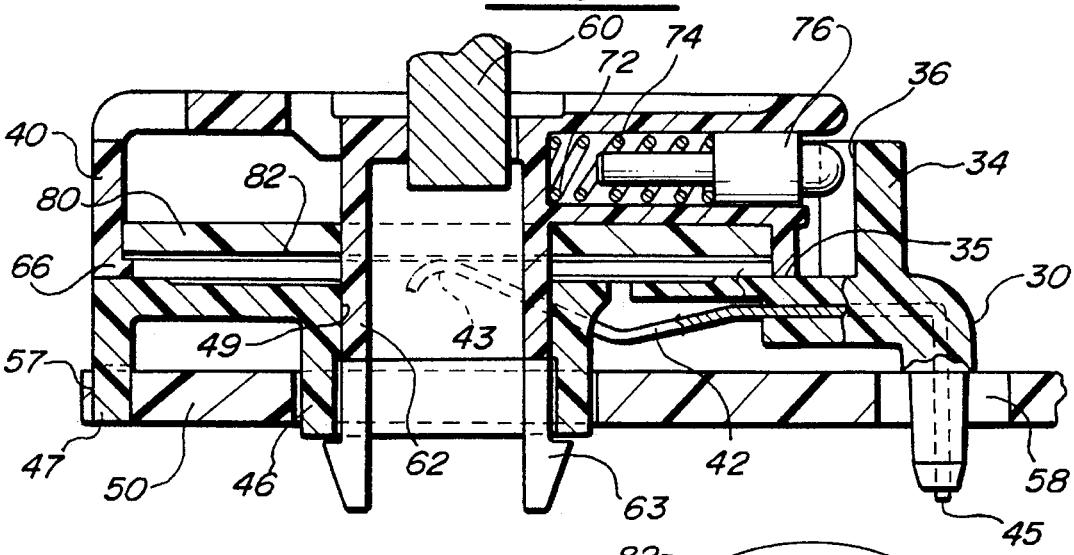
Fig-4
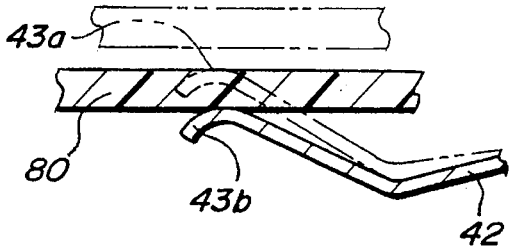
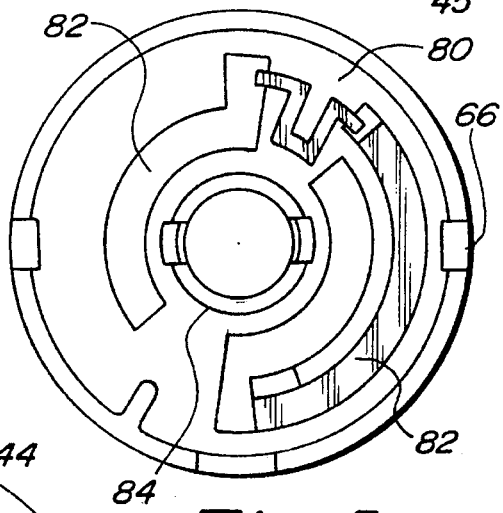
Fig-5
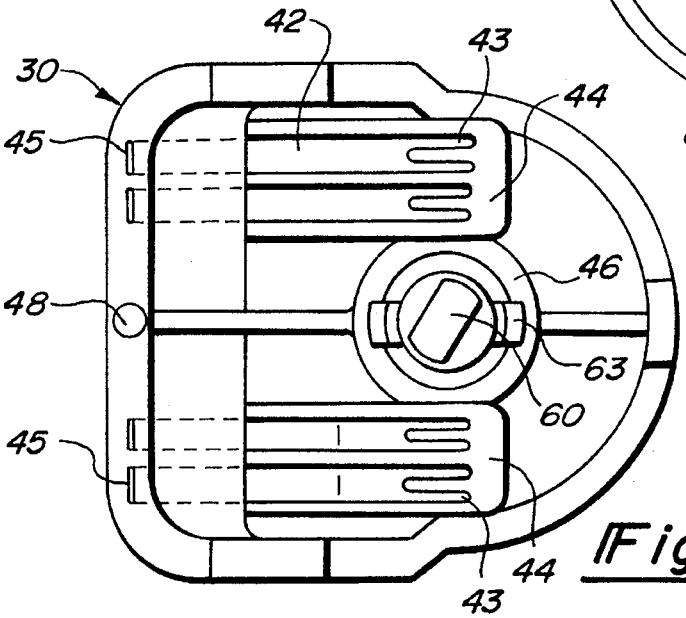
Fig-6

ROTARY POTENTIOMETER ASSEMBLY FOR A PUSH-PULL SWITCH

BACKGROUND OF THE INVENTION

The present invention relates to a rotary dimmer switch which is compact, and accurately positions the circuit components. The invention also relates to a method of assembling the rotary switch.

Headlight switches for actuating the parking and headlights by a pulling or pushing action are known. Such switches are commonly combined with a rotary switch for dimming or brightening the panel lights on the dashboard by a rotary motion. This type of switch utilizes conductive contacts which are moved along conductive circuit paths by the rotary motion.

In the past, it has been somewhat difficult to allow easy rotational movement of the rotating circuit elements, while still properly positioning the rotating circuit elements relative to the fixed circuit elements. The prior art has had some difficulty in creating a structure that functions properly and reliably, while not resulting in an unduly large switch housing. Moreover, the prior art has had some difficulties in providing an easily assembled switch. Finally, the prior art has often demanded relatively close tolerances to ensure that the various circuit elements are properly positioned relative to each other.

Space is at a premium in modern vehicles, and it would be desirable to decrease the size of the prior art switches. It would also be desirable to decrease the difficulty of assembly and reduce the necessity of close tolerances in rotary switches.

SUMMARY OF THE INVENTION

In a disclosed embodiment of this invention, a rotary switch comprises a fixed housing that hold contact members from a circuit board at a position where their free ends are facing a rotating circuit element. The fixed housing receives and guides the rotating circuit element. The rotating circuit element is positioned on a carrier assembly that is connected to the fixed housing, but is guided for rotation on the fixed housing. The carrier assembly is connected to the fixed housing by a cylindrical shaft, and has locking fingers that snap through the shaft. The contact arms extend from the fixed housing into contact with the circuit element carried on the carrier assembly. The fixed housing thus guides the rotating carrier element for rotation, while at the same time ensuring that the contact arms are in contact with the circuit traces on the circuit element. In a preferred embodiment of this invention, the circuit element biases the contact arm from a relaxed position when the carrier element is received on the fixed housing. The fixed housing preferably has a shoulder providing additional rotational guidance. The shoulder preferably carries detent notches which selectively receive a spring biased detent from the carrier assembly.

The fixed housing, which could be termed a cam contact assembly, properly positions the contact arm relative to the circuit board, while at the same time ensuring that the contact arms are maintained in contact with the rotating circuit traces. Further, the guidance of the carrier element on the cam contact assembly ensures that the several circuit elements will be properly positioned relative to each other, and that precise dimensional tolerances are unnecessary.

In a method of assembly a rotary switch according to this invention, the circuit element is connected to the rotating carrier assembly. The fixed cam contact assembly is connected to a circuit board with the contact arms extending upwardly from the-cam contact assembly. The rotating carrier assembly is guided for rotation on the fixed cam contact assembly. The inventive switch assembly may be assembled by initially connecting the carrier assembly to the fixed cam contact assembly, and then connecting the fixed cam contact assembly to the circuit board. Alternatively, the fixed cam contact assembly could be initially connected to the circuit board, and the rotating carrier assembly then connected to the fixed cam contact assembly.

These and other features of the present invention will be best understood from the following specification and drawings, of which the following is a brief description.

BRIEF DESCRIPTION OF THE DRAWINGS

FIG. 1 is a perspective view of a rotary switch assembly in accordance with the invention herein.

FIG. 2 is a top plan view of the assembly of FIG. 1;

FIG. 3 is a cross-sectional view along line 3—3 as shown in FIG. 2;

FIG. 4 is a partial view of a contact arm and the circuit element of the assembly of FIG. 1;

FIG. 5 is a bottom plan view of a carder member of the assembly of FIG. 1;

FIG. 6 is a bottom plan view of the cam contact assembly of the assembly of FIG. 1.

DETAILED DESCRIPTION OF A PREFERRED EMBODIMENT OF THE INVENTION

Figure 7:
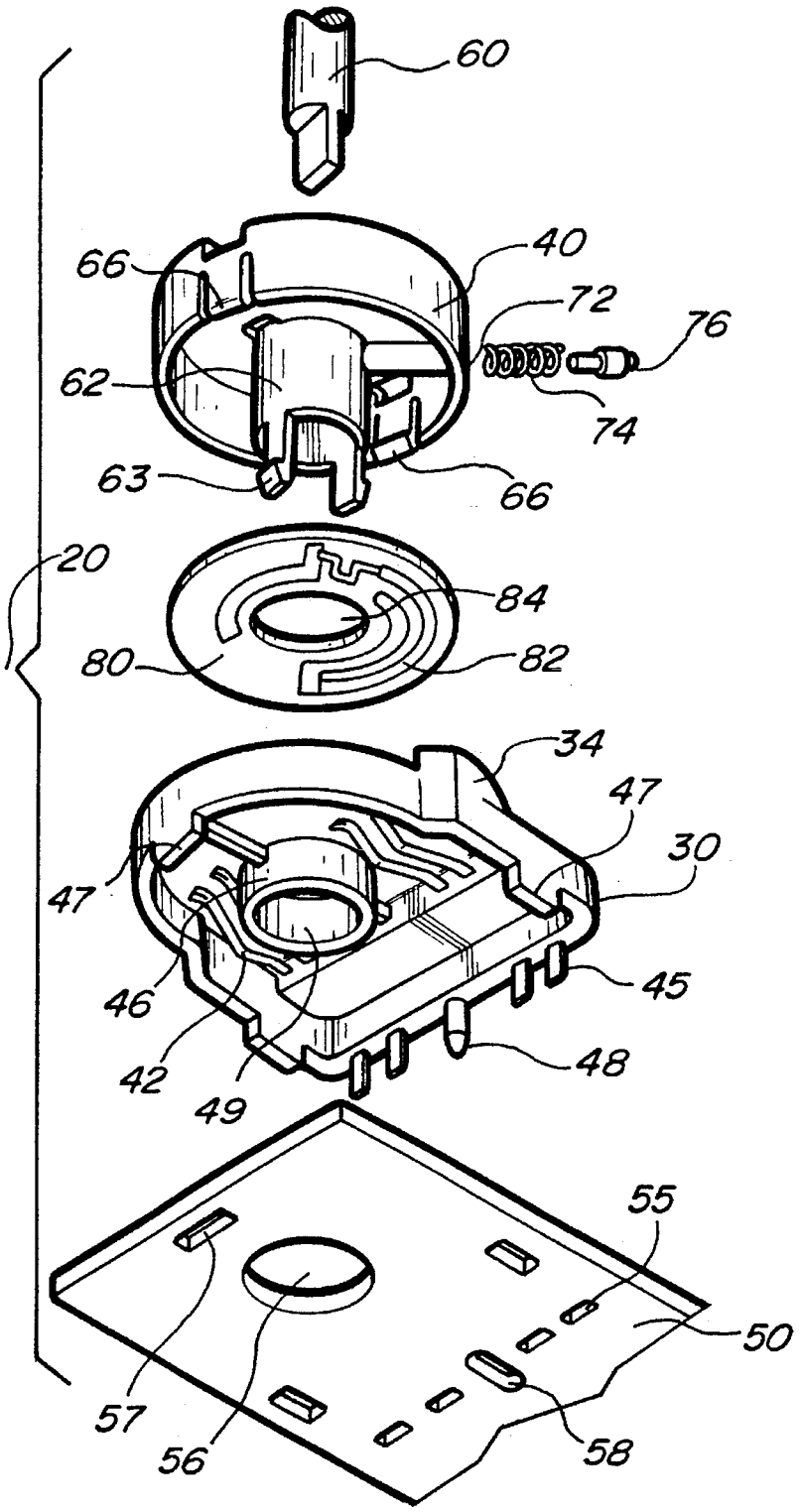
FIG. 7 is an exploded perspective view of the assembly of FIG. 1.

As shown in FIG. 1, an inventive rotary potentiometer assembly 20 has a stationary cam contact assembly 30 and a rotating carrier assembly 40, which are arranged on a circuit board 50. A shaft 60, which is part of a push-pull switch, controls the operation of a vehicle's headlights by moving between "in" and "out" positions. The details of this function are not part of this invention, and are not shown in the drawings. At the same time, the shaft 60 may be rotated about its longitudinal axis to operate a dimming function, or actuate other lights, as described below.

As shown in FIG. 2, the cam contact assembly 30 includes a base 32 and a semi-circular shoulder 34 extending from the base 32. Detent notches 36 are formed on an inner periphery of shoulder 34. A detent plunger 76 is selectively received in the detents 36. At the ends of shoulder 34 are stop members 38, which prevent detent plunger 76, and hence carrier assembly 40, from rotating beyond the stop members. Cam contact assembly 30 is secured to the circuit board 50, and does not rotate with the shaft 60. Rather, shaft 60 rotates the carrier assembly 40. An opening 68 receives shaft 60, which can move into and out of the plane of this figure, but which rotates carrier assembly 40 when turned. A positioning pin 48 is received in a slot 58 in circuit board 50 to properly orientate the cam contact assembly 30 on circuit board 50.

As shown in FIG. 3, the rotary potentiometer assembly 20 is compact and provides precise positioning between the contact arms 42 and rheostat circuit trace surfaces 82 formed on a circuit element 80. Carrier assembly 40 supports circuit element 80 on a central shaft 62 such that the circuit element 80 and carrier assembly 40 rotate together. Finger securement members 63 snap over the base of a cam contact assembly central shaft 46, retaining carrier assembly 40 on cam contact assembly 30. Carrier assembly central shaft 62 is smoothly guided for rotation in orifice 49 of cam assembly central shaft 46. Contact arms 42 are biased against surfaces 82 on circuit element 80. A radial notch 72 receives a detent spring 74 and detent plunger 76. Detent spring 74 biases detent plunger 76 into detent notches 36 located on the inner periphery of shoulder 34 of cam assembly 30. As shown, the shoulder 34 extends upwardly from a surface 35 that supports the carrier assembly 40. As an operator rotates shaft 60, carrier assembly 40 and circuit element 80 rotate with shaft 60 and surfaces 82 sweep across contact arms 42, completing the electrical contact to circuit board 50. In prior art combination rotary and push-pull switches, the composite switch required a much larger assembly and the proper positioning of the circuit members was somewhat difficult to achieve. Since the inventive cam contact assembly carries the contact arms 42 and guides the carder assembly 40, it ensures the proper positioning of the parts. Moreover, the close rotational guidance allows greater dimension tolerances.

Contact arm free end 43 is shown in FIG. 4 prior to assembly, at phantom line 43*a*. As carrier assembly 40 including circuit element 80 is moved onto cam contact assembly central shaft 46, contact arm free end 43*a* comes in contact with circuit element 80 and surfaces 82. When fingers 63 snap over shaft 46, carrier assembly 40 and circuit element 80 bias the contact arms 42 down leaving contact arm free ends in position 43*b*.

When shaft 60 is rotated around its central longitudinal axis, cam contact assembly 30 remains stationary, but carrier assembly 40 and circuit element 80 rotate. Detent plunger 76 moves between detents 36. At maximum rotational positions, stop members 38 prevent detent plunger 76, and therefore carrier assembly 40, from rotating. Preferably, stop members are spaced by about 180°. Detents 36 provide a clicking feel to the operator as the shaft 60 is rotated between stop members 38. As shaft 60 is rotated, contact arms 42 sweep across the surfaces 82. At least one of the detent positions defines an additional function other than the panel light dimming function. One of the rotational extent detents may actuate a light, such as a dome light, of the vehicle.

As shown in FIG. 5, circuit element 80 contains the appropriate layout of conductive and resistive circuit traces 82 circularly disposed and peripherally spaced on the substrate. The design of surfaces 82 is defined by the functions controlled by rotation of the push-pull switching component and forms no portion of this invention. As known, the surfaces 82 contain resistive or conductive material that controls a specific function; e.g., dimming the panel lights in a vehicle.

As shown in FIG. 6, contact arms 42 have a free end 43 for contacting a circuit element. Contact arms 42 (four in this embodiment) are molded into base 32 and extend from the bottom of the cam contact assembly 30. The opposed ends 45 of the contact arms 42 are soldered to the circuit board 50. A positioning pin 48 assists in positioning the cam contact assembly 30 on the circuit board 50.

As shown in FIG. 7, the cam contact assembly 30 includes a central cylindrical shaft 46 which fits into an opening 56 of circuit board 50. Cylindrical shaft 46 also defines an orifice 49 which receives shaft 62 to guide rotation of the carrier assembly 40. Pin 48 fits into aperture 58 of circuit board 50 and several flanges 47 of cam assembly 30 fit into channels 57 of circuit board 50, positioning the cam assembly 30 on the circuit board 50. Adhesive may also be applied to the channels 57 to further secure the cam assembly 30 to the circuit board 50. Although one orientation of circuit board 50 is shown, it should be understood that the circuit board orientation is typically dictated by the application. Thus, other orientations are within the scope of this invention.

The circuit element 80 central aperture 84 is received on the carrier assembly central cylindrical shaft 62, and secured by snapping members 66. Aperture 84 is slid along central shaft 62 until the snapping members 66 snap over the outer peripheral edge of the circuit element 80. The aperture 84 of the circuit element 80 preferably has a flat portion with a similar flat portion on the outer periphery of carrier assembly central shaft 62, providing additional positioning control of the surfaces 82.

After the circuit element 80 is arranged on carrier assembly 40, as described above, the carrier assembly 40 is positioned on cam contact assembly 30 by sliding carrier assembly shaft 62 through cam assembly orifice 49 until finger members 63 snap over the base of cam assembly cylindrical shaft 46. The cam assembly central shaft orifice 49 receives carrier assembly central shaft 62 to guide and control the rotation of carrier assembly 40.

In a method of assembling a rotary switch assembly for a push-pull switch according to this invention, cam contact assembly 30 may be secured to circuit board 50. The ends 45 of contact arms 42 are connected to circuit board 50. The ends may be soldered. The circuit element 80 is located on carrier assembly 40 by slipping carrier assembly central shaft 62 through central aperture 84 of circuit element 80 with the surfaces 82 facing outwardly. Carrier assembly 40 is located onto cam assembly 30 by slipping carrier assembly central shaft 62 through orifice 49 of cam assembly 30 until finger members 63 snap over the base of cam assembly central shaft 46. Detent plunger 76 is then located between stop members 38. The contact arms are biased by contact with the circuit element, as shown in FIG. 4, when the circuit element is positioned such that fingers 63 snap over the base and biased into detents 36.

A preferred embodiment of this invention has been disclosed; however, a worker of ordinary skill in the art would recognize that certain modifications would come within the scope of this invention. For that reason, the following claims should be studied in order to determine the true scope and content of this invention.

We claim:

1. A rotary dimmer switch assembly to be incorporated into a push-pull switch, comprising:

a contact holder having an orifice, and a plurality of contact arms disposed in said cam contact assembly and electrically connected to a circuit board, and having an opposed free end;

a carrier assembly having a central cylindrical shaft, said shaft defining a rotational orifice, said shaft disposed in said contact holder orifice, said contact holder orifice guiding said carrier assembly for relative rotary movement, and a push-pull switching component extending along an axis and received in said rotational orifice;

a circuit element having an exposed circuit trace and rotating with said carrier assembly, said circuit element disposed with said circuit trace facing and contacting said contact arm free ends; and wherein rotation of said switching component about said axis rotates said carrier assembly and said circuit element, sweeping said circuit trace over said contact arm free ends.

2. The dimmer switch assembly as recited in claim 1, wherein said circuit trace comprises a series of circularly disposed, peripherally spaced, resistive layers.

3. The dimmer switch as recited in claim 2, wherein said resistive layers actuate a dome light when said switching component is rotated to one rotational extent with said contact arms free ends contacting an extreme location of said resistive layers.

4. The dimmer switch assembly as recited in claim 3, wherein said carrier assembly carries a detent plunger which is selectively received in a detent notch in said cam contact assembly to maintain said circuit element at said extreme location.

5. The dimmer switch assembly as recited in claim 4, wherein said cam contact assembly includes a plurality of detent notches extending around an inner periphery of a shoulder which extends upwardly from a base for guiding said carrier assembly.

6. The dimmer switch assembly as recited in claim 1, wherein said carrier assembly carries a detent plunger received in a detent notch in said cam contact assembly to maintain said circuit element at a desired location, and there being a plurality of said detent notches formed in a shoulder on said cam contact assembly which extends upwardly from a base for guiding said carder assembly.

7. The dimmer switch assembly as recited in claim 6, wherein said shoulder extends approximately only 180° around said cam contact assembly.

8. The dimmer switch assembly of claim 7, wherein said shoulder includes stop members which restrict rotation of said carrier assembly and said circuit element.

9. The dimmer switch assembly as recited in claim 1, wherein said carrier assembly is secured to said cam contact assembly by an attachment member on said carrier assembly which includes two finger members extending downwardly from said shaft, and which snap over a base of said orifice in said contact holder.

10. The dimmer switch assembly as recited in claim 1, wherein a shoulder extending upwardly from a base of said cam contact assembly assists in guiding rotation of said carrier assembly.

11. The dimmer switch assembly as recited in claim 1, wherein said contact arm free ends are biased away from a relaxed position by being in contact with said circuit element.

12. The dimmer switch as recited in claim 1, wherein said contact arms are soldered to connections in said circuit board.

13. A rotary switch assembly to be incorporated into a push-pull switch comprising:

a fixed cam contact assembly having a shoulder extending upwardly from a base, and having a plurality of detents, a plurality of contact arms disposed in said cam contact assembly and electrically connected to a circuit board and having an opposed free end, said cam contact assembly attached to said circuit board;

a carrier assembly having a rotational orifice, and attachment members, a detent plunger, and a detent spring, said carrier assembly received on said cam contact assembly with said attachment members retaining said carrier assembly on said cam assembly, and said carrier assembly being guided for rotary movement relative to said cam contact assembly, and a push-pull switching component received in said rotational orifice;

a circuit element having an exposed circuit trace surface including a series of circularly disposed resistive layers, said circuit element rotating with said carrier assembly, said trace surface disposed facing and in contact with said contact arm free ends; and wherein rotation of said switching component rotates said carrier assembly and circuit element, sweeping said circuit trace surface over said contact arm free ends, thereby controlling said at least one light function.

14. A rotary dimmer switch assembly as recited in claim 13, wherein said shoulder extends 180° around said cam contact assembly and said shoulder includes stop members at 0° and 180° which restrict rotation of said carrier assembly and said circuit element.

15. A rotary dimmer switch assembly as recited in claim 14, wherein said carrier assembly includes a cylindrical shaft received within a cylindrical orifice in said cam contact assembly, and said cylindrical orifice and said shoulder guiding said carrier assembly for rotation relative to said cam contact assembly.

16. The dimmer switch assembly as recited in claim 13, wherein said resistive layers actuate a dome light when said switching component is rotated to one rotational extent with said contact arms free ends contacting an extreme location of said resistive layers.

17. A rotary dimmer switch assembly as recited in claim 13, wherein said cam contact assembly includes a positioning pin which extends within an opening in said circuit board to properly position said cam contact assembly relative to said circuit board.

18. A rotary dimmer switch assembly as recited in claim 13, wherein said contact arm free ends are biased away from a relaxed position by contact with said circuit element.

19. A rotary dimmer switch assembly as recited in claim 13, wherein said contact arms are soldered to connections in said circuit board.

* * * * *